US010127757B2

(12) United States Patent
Kim

(10) Patent No.: US 10,127,757 B2
(45) Date of Patent: Nov. 13, 2018

(54) PATH SWITCHING STRUCTURE AND MEDIUM STORAGE APPARATUS AND FINANCIAL DEVICE HAVING THE SAME

(71) Applicant: ATEC AP CO., LTD., Seongnam-si, Gyeonggi-do (KR)

(72) Inventor: Hak Kyum Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/678,766

(22) Filed: Aug. 16, 2017

(65) Prior Publication Data

US 2018/0053366 A1 Feb. 22, 2018

(30) Foreign Application Priority Data

Aug. 17, 2016 (KR) ..... 10-2016-0104507

(51) Int. Cl.
*B65H 29/60* (2006.01)
*G07D 11/00* (2006.01)
*B65H 29/58* (2006.01)

(52) U.S. Cl.
CPC ..... *G07D 11/0033* (2013.01); *B65H 29/58* (2013.01); *B65H 29/60* (2013.01); *B65H 2404/632* (2013.01)

(58) Field of Classification Search
CPC .... G07D 11/0033; B65H 29/58; B65H 29/60; B65H 2404/63; B65H 2404/631; B65H 2404/632; B65H 2404/633
See application file for complete search history.

(56) References Cited

U.S. PATENT DOCUMENTS 5,570,877 A * 11/1996 Asami ..... B65H 29/12 271/186
6,196,464 B1 * 3/2001 Patterson ..... B65H 29/006 235/477
6,394,446 B1 * 5/2002 Okamoto ..... B65H 29/58 271/186
6,725,011 B2 * 4/2004 Sato ..... G03G 15/6552 399/405

(Continued)

FOREIGN PATENT DOCUMENTS

KR 1020120097457 A 9/2012
KR 1020120104736 A 9/2012

(Continued)

*Primary Examiner* — Jeremy R Severson
(74) *Attorney, Agent, or Firm* — Dentons US LLP

(57) ABSTRACT

The path switching structure according to the present disclosure includes a branch part from which a plurality of transfer paths along which a medium is transferred is branched, and a medium branch apparatus having a diverter guiding the medium introduced to the branch part along any one of the plurality of transfer paths to another transfer path among the plurality of transfer paths, wherein the plurality of transfer paths include a first transfer path along which the medium is introduced to the branch part, a second transfer path in which the medium is introduced to the branch part or the medium is discharged from the branch part, and a third transfer path in which the medium is introduced to the branch part or the medium is discharged from the branch part, and the diverter is rotated between a first position a second position.

14 Claims, 5 Drawing Sheets

(56) References Cited

U.S. PATENT DOCUMENTS

| | | | | |
|---|---|---|---|---|
| 8,167,304 | B2 * | 5/2012 | Fukazawa | B65H 29/58 271/225 |
| 8,985,303 | B2 * | 3/2015 | Okamoto | B65G 47/52 198/367 |
| 8,991,824 | B2 * | 3/2015 | Suzuki | G03G 15/234 271/265.01 |
| 9,329,552 | B2 * | 5/2016 | Haruyama | G03G 15/6529 |
| 9,708,148 | B2 * | 7/2017 | Yoshitsugu | B65H 29/52 |
| 2015/0344255 | A1 | 12/2015 | Moon | |
| 2016/0145063 | A1 * | 5/2016 | Segers | B65H 5/36 271/225 |

FOREIGN PATENT DOCUMENTS

| | | | |
|---|---|---|---|
| KR | 101250657 | B1 | 4/2013 |
| KR | 20160001939 | A | 1/2016 |
| WO | 2015151539 | A1 | 10/2015 |

* cited by examiner

PATH SWITCHING STRUCTURE AND MEDIUM STORAGE APPARATUS AND FINANCIAL DEVICE HAVING THE SAME

CROSS-REFERENCE TO RELATED APPLICATION

This application is based on and claims the benefit of priority to Korean Patent Application No. 10-2016-0104507, filed on Aug. 17, 2016, in the Korean Intellectual Property Office, the disclosure of which is incorporated herein in its entirety by reference.

TECHNICAL FIELD

The present disclosure relates to a path switching structure and a medium storage apparatus and a banking device having the same.

BACKGROUND

In general, a banking device refers to a device which processes financial services that clients want. The banking device may perform a function to deposit or withdraw a medium, automatically transfer a medium, and the like. The banking device may include a medium handling apparatus for depositing or withdrawing a medium.

The medium handling apparatus includes a medium storage module for storing a deposited medium or a medium to be withdrawn, and transfer paths allowing a medium to be transferred therealong may be provided between medium storage modules or between a medium deposit/withdrawal part and a medium storage module. A medium passing along a transfer path is branched from a branch point of the transfer path and moves to an appropriate medium storage module or transfer path.

SUMMARY

The present disclosure has been made to solve the above-mentioned problems occurring in the prior art while advantages achieved by the prior art are maintained intact.

An aspect of the present disclosure provides a path switching structure capable of accurately and stably switching a path of a medium without driving a separate solenoid or without providing power, and a medium storage apparatus and a banking device having the same.

According to an exemplary embodiment of the present disclosure, a path switching structure includes: a branch part from which a plurality of transfer paths along which a medium is transferred is branched; and a medium branch apparatus having a diverter guiding the medium introduced to the branch part along any one of the plurality of transfer paths to another transfer path among the plurality of transfer paths, wherein the plurality of transfer paths include a first transfer path along which the medium is introduced to the branch part, a second transfer path in which the medium is introduced to the branch part or the medium is discharged from the branch part, and a third transfer path in which the medium is introduced to the branch part or the medium is discharged from the branch part, and the diverter is rotated between a first position linking the second transfer path and the third transfer path and a second position linking the first transfer path and the second transfer path and is rotated from the first position to the second position by a force applied by the medium introduced to the branch part along the first transfer path.

After the diverter is rotated to the second position, when a force by the medium is not applied any longer, the diverter may be restored from the second position to the first position.

The path switching structure may further include: an elastic member connected to the medium branch apparatus and providing a restoring force when the diverter is restored from the second position to the first position.

The path switching structure may further include: a guide member having a first guide surface guiding the medium transferred along the first transfer path, wherein, when a force by the introduced medium is applied, the diverter may be rotated from the first position to the second position, and when the force is not applied, the diverter may be mounted on the first guide surface and maintained in the first position.

The guide member may further include a second guide surface guiding the medium transferred along the second transfer path.

The guide member may further include a bent portion formed to be bent between the first guide surface and the second guide surface, and in a state in which the diverter is mounted on the first guide surface spaced apart from the bent portion as an end portion of the diverter is mounted on the first guide surface, the second guide surface may protrude toward the second transfer path, relative to the diverter.

The diverter may include a first surface disposed on the first transfer path and coming into contact with the medium transferred along the first transfer path and a second surface disposed on the third transfer path, and the first surface may have a planar shape and come into line-contact or surface-contact with the medium transferred along the first transfer path in a direction perpendicular to a direction in which the medium is transferred.

When the diverter is placed in the first position, the bent portion may protrude toward the second transfer path, relative to the second surface.

The medium branch apparatus may further include a rotational shaft on which the diverter is mounted, and the diverter may have a shape in which a cross-section of the rotational shaft in an axial direction is narrowed toward an end portion of the diverter.

The diverter may extend in the axial direction of the rotational shaft and may include a plurality of roller position recesses provided to be depressed in the direction perpendicular to the rotational shaft and disposed in the axial direction of depressed in the axial direction of the rotational shaft.

A plurality of diverters may be mounted to be spaced apart from each other in the axial direction of the rotational shaft, and a plurality of roller position recesses may be provided between the plurality of diverters.

The first guide surface may have a flat shape, come into line-contact or surface-contact with the first surface of the diverter in a direction perpendicular to a transfer direction in which the medium is transferred along the first transfer path, and have a roller hole formed in a penetrating manner to correspond to the roller position recess.

The path switching structure may further include: a separating member transferring the medium moving along the first transfer path and the second transfer path, wherein the separating member may include: a first separating roller; and a second separating roller installed to be engaged with the first separating roller, rotated according to driving of the first separating roller, and insertedly installed in the roller hole to transfer the medium introduced to the first transfer path and the second transfer path.

According to another exemplary embodiment of the present disclosure, a medium storage apparatus includes: a medium inlet allowing a medium to be introduced therethrough; a medium accumulation space allowing the medium introduced through the medium inlet to be accumulated therein; and a medium outlet allowing the medium accumulated in the medium accumulation space to be discharged therethrough; and a path switching structure switching a path along which the introduced or discharged medium is transferred, wherein the path switching structure includes: a branch part from which a plurality of transfer paths along which a medium is transferred is branched; and a medium branch apparatus having a diverter guiding the medium introduced to the branch part along any one of the plurality of transfer paths to another transfer path among the plurality of transfer paths, wherein the plurality of transfer paths include a first transfer path along which the medium is introduced to the branch part, a second transfer path in which the medium is introduced to the branch part or the medium is discharged from the branch part, and a third transfer path in which the medium is introduced to the branch part or the medium is discharged from the branch part, and the diverter is rotated between a first position linking the second transfer path and the third transfer path and a second position linking the first transfer path and the second transfer path and is rotated from the first position to the second position by a force applied by the medium introduced to the branch part along the first transfer path.

According to another exemplary embodiment of the present disclosure, a banking device includes: a deposit/withdrawal part allowing a medium to be deposited or withdrawn; and a medium handling apparatus handling a medium deposited to the deposit/withdrawal part, a medium which is withdrawn, or a medium returned after being deposited to the deposit/withdrawal part and including a plurality of transfer paths along which a medium is transferred, a branch part from which the plurality of transfer paths are branched, and a path switching structure switching a path of a medium transferred from the branch part, wherein the path switching structure includes: a medium branch apparatus having a diverter guiding the medium introduced to the branch part along any one of the plurality of transfer paths to another transfer path among the plurality of transfer paths, wherein the plurality of transfer paths include a first transfer path along which the medium is introduced to the branch part, a second transfer path in which the medium is introduced to the branch part or the medium is discharged from the branch part, and a third transfer path in which the medium is introduced to the branch part or the medium is discharged from the branch part, and the diverter is rotated between a first position linking the second transfer path and the third transfer path and a second position linking the first transfer path and the second transfer path and is rotated from the first position to the second position by a force applied by the medium introduced to the branch part along the first transfer path.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
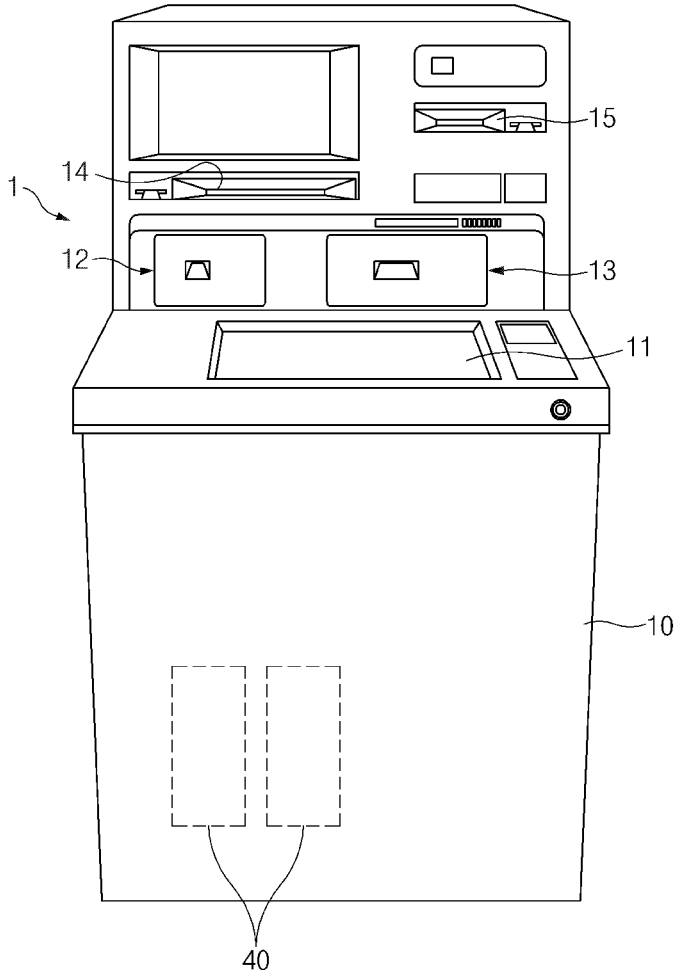
FIG. 1 is a perspective view illustrating a banking device according to an exemplary embodiment of the present disclosure.

Hereinafter, exemplary embodiments of the present disclosure will be described in detail with reference to the accompanying drawings. For reference, dimensions of elements or thicknesses of lines illustrated in the drawings referred to describe the present disclosure may be exaggerated for the convenience of understanding. Also, the terms used henceforth have been defined in consideration of the functions of the present disclosure, and may be altered according to the intent of a user or operator, or conventional practice. Therefore, the terms should be defined on the basis of the entire content of this specification.

A banking device according to an exemplary embodiment of the present disclosure is a device for providing financial services to receive various mediums such as bills, bonds, giro, coins, gift tokens, and the like, and perform handling such as depositing, payment through giro (or electronic billing system), exchange of gift tokens, and/or handling mediums such as withdrawing, discharging giro, discharging gift tokens, and the like. The banking device may include an automatic teller machine (ATM) such as a cash dispenser (CD), a cash recycling device, and the like. However, the banking device is not limited thereto and may also be a device for automating financial services such as a financial information system (FIS).

Hereinafter, exemplary embodiments of the present disclosure will be described on the assumption that the banking device is an ATM. However, such an assumption is for the purposes of description and a technical concept of the present disclosure is not limited thereto.

FIG. 1 is a perspective view schematically illustrating a banking device according to a first exemplary embodiment of the present disclosure.

Referring to FIG. 1, a banking device 1 according to an exemplary embodiment of the present disclosure may include a medium handling apparatus for handling a medium.

The banking device 1 may further include a client information obtaining part for obtaining client information.

The client information obtaining part may include a bankbook handling module 14 for recognizing a bankbook such that a bankbook may be received and discharged. Alternatively, the client information obtaining part may include a card handling module 15 allowing a card to be received and discharged and recognizing a card.

In the present exemplary embodiment, the client information obtaining part is not limited in type and may obtain information recorded in an RFID tag based on near-field communication (NFC) or a USB or obtain client information using biometric information such as a fingerprint, or the like.

The banking device 1 may further include a user interface 11 for displaying a menu and information for deposit or withdrawal and inputting or selecting a command or information for deposit or withdrawal.

The banking device 1 may further include a controller (not shown) for controlling the medium handling apparatus, the client information obtaining part, the user interface 11, and the like. Here, the controller may include a medium handling apparatus controller controlling the medium handling apparatus and a banking device controller controlling the banking device 1.

The medium handling apparatus may include an upper module and a lower module. The upper module may be detachably connected to the lower module or may be movably connected to the lower module. Alternatively, the upper module and the lower module may be maintained in a contacted state, rather than being connected to each other.

The medium handling apparatus may include medium input/output modules 12 and 13 for inputting and outputting a medium.

The medium input/output modules 12 and 13 may include a medium receiving space which can be accessed by a client and the medium receiving space may be opened and closed by a covering member such as a shutter and/or cover. The medium receiving space may occasionally be maintained in an opened state, without being opened or closed. The medium receiving space may be partitioned into a plurality of receiving spaces by a partitioning member.

The medium input/output modules 12 and 13 may serve as a common input/output part allowing a plurality of mediums such as bills, checks, and gift tokens, for example, to be drawn in or out. A medium may be introduced as a sheet or in units of bundle to the medium input/output module 12 or 13. Also, a medium may be discharged as a sheet or in units of bundle from the medium input/output module 12 or 13.

Within the medium input/output module 12 or 13, a draw-in space to which a medium is drawn and a draw-out space from which a medium is drawn out may be distinguished from each other. Alternatively, the medium input/output module 12 or 13 may include an independent medium drawn-in module and an independent medium drawn-out module.

The medium handling apparatus may further include an identifying module (not shown). The identifying module may identify a type, a thickness, an amount, and the like, of a medium during a deposit transaction process, a withdrawal transaction process, and the like, or identify a defective medium.

The medium handling apparatus may further include a temporary accumulating module for temporarily accumulating a medium.

In cases where a client wants to deposit a medium to the banking device 1, the temporary accumulating module may temporarily accumulate the medium received through the medium input/output module.

The medium accumulated in the temporary accumulating module may be transferred to a medium storage part (to be described hereinafter) when the client finally determines to deposit the medium. Alternatively, the temporary accumulating module may temporarily accumulate a medium to be transferred to the medium input/output module.

The medium handling apparatus may further include the medium storage part for storing a medium. The medium storage part may include a plurality of medium storage modules 40.

The plurality of medium storage modules 40 may include one or more bill storage modules and one or more check storage modules. In this disclosure, however, the number of the bill storage modules and the number of the check storage modules are not limited. In another example, the medium storage part may include only the bill storage module or only the check storage module. Alternatively, the plurality of medium storage modules may include a storage module storing a gift token, marketable securities, a ticket, and the like. Alternatively, the check storage module may be replaced with a storage module storing a gift token, marketable securities, a ticket, and the like.

The medium handling apparatus may further include a supplementing/retrieving module (not shown) for supplementing or retrieving a medium. The supplementing/retrieving module may store one or more mediums among a medium to be supplemented in the medium storage part or a medium retrieved from the medium storage part.

The medium handling apparatus may further include a retrieving module (not shown). A medium determined as a defective medium during one or more of a medium deposit transaction process, a medium withdrawal transaction process, a medium supplementing process, and a medium retrieving process may be retrieved to the retrieving module. In other words, a medium which was drawn out to the medium input/output module but which has not been received by a client and/or which has been determined as a defective medium by the identifying module or which has not been identified by the identifying module may be received by the retrieving module.

Also, when the banking device includes a check input/output function, the medium handling apparatus may further include a deposited check retrieval space to which a deposited check transferred from the medium input/output module is retrieved. Here, the deposited check may be retrieved such that a check issued by a bank which operates the banking device and a check issued by another bank are distinguished from each other. The deposited check retrieval space may also be configured as a module separate from the retrieving module, and may be distinguishably accumulated in a space partitioned within the retrieving module. The retrieving module and/or the check retrieval space may be positioned on a rearmost side of the banking device 1 such that a clerk, a manager, and the like, may open a door to easily access the retrieving module and/or the check retrieval space.

The medium handling apparatus may include a transfer module from which a medium introduced for deposit or a medium to be discharged for withdrawal is to be transferred to each module.

The medium handling apparatus may have a plurality of transfer paths along which a deposited medium or a withdrawn medium or a medium returned after being deposited to the deposit/withdrawal part is transferred and a branch part from which the plurality of transfer paths are branched. Also, the medium handling apparatus may include a medium branch apparatus switching a path of a medium transferred from the branch part.

Figure 2:
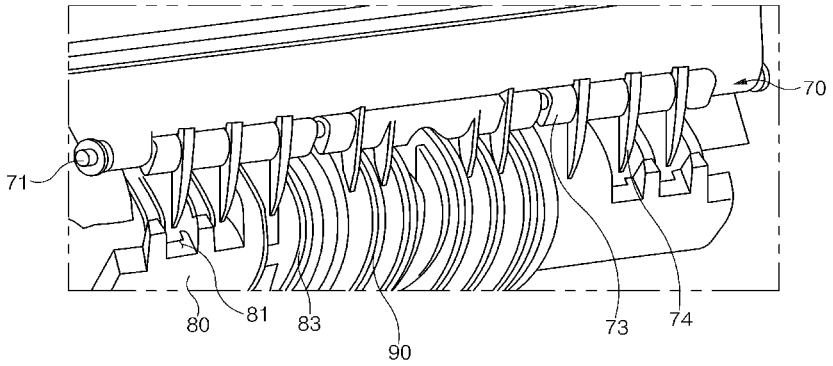
FIG. 2 is a partial perspective view illustrating a related art medium branch apparatus and a guide.

FIG. 2 illustrates a related art medium branch apparatus 70.

The related art medium branch apparatus 70 may include a rotational shaft 71 rotatably driven according to an electrical signal, a diverter 73 inserted and fixed to the rotational shaft 71, and a plurality of blades 74 protruding from an outer circumferential surface of the diverter 73 and having an eggplant shape.

The medium handling apparatus includes a guide 80 guiding transfer of a medium. The guide 80 may have an insertion recess 81 to which an end portion of each of the plurality of blades 74 is inserted and a roller position recess 83 to which a transfer roller 90 transferring the guide 80 is inserted to penetrate therethrough.

The related art medium branch apparatus 70, however, has a problem in which the blade 74 of the diverter 73 having an eggplant shape damages a medium when coming into contact with the medium being transferred. Also, a medium may be caught between the blade 74 and the guide 80 to cause a jam. Here, if the blade 74 and at least a portion of an upper surface of the guide 80 are formed to overlap to solve the problem, a length of the blade 74 may be increased and a large installation space may be required.

Also, if an end portion of the blade 74 is not properly inserted into the insertion recess 81 of the guide 80 due to component tolerance or assembly tolerance, a transferred medium may be caught by the blade 74 of the diverter 73 to cause a jam.

In addition, since the rotational shaft 71 of the related art medium branch apparatus 70 is driven with an electrical signal by a solenoid valve, or the like, a separate driver for driving the rotational shaft 71 and a component for transmitting a signal are required.

FIGS. 3 to 8 illustrate an exemplary embodiment of a path switching structure according to the present disclosure to solve the related art problem described above. The path switching structure described hereinafter may be applied to every transfer path of the medium handling apparatus provided within the banking device 1. That is, the path switching structure may be applied to every transfer path along which a medium is transferred, such as the identifying part, the temporary accumulating part, and the like, as well as the transfer path applied to the medium storage apparatus.

The path switching structure according to an exemplary embodiment of the present disclosure may include a branch part 120 in which a plurality of transfer paths 110 along which a medium is transferred are branched and a medium branch apparatus 150 having a diverter 153 guiding a medium introduced to the branch part 120 along any one of the plurality of transfer paths 110 to another path among the plurality of transfer paths 110.

Also, the plurality of transfer paths 110 may include a first transfer path 111 along which a medium is introduced to the branch part 120, a second transfer path 112 along which a medium is introduced to the branch part 120 or discharged from the branch part 120, and a third transfer path along which a medium is introduced to the branch part 120 or discharged from the branch part 120.

Figure 4:
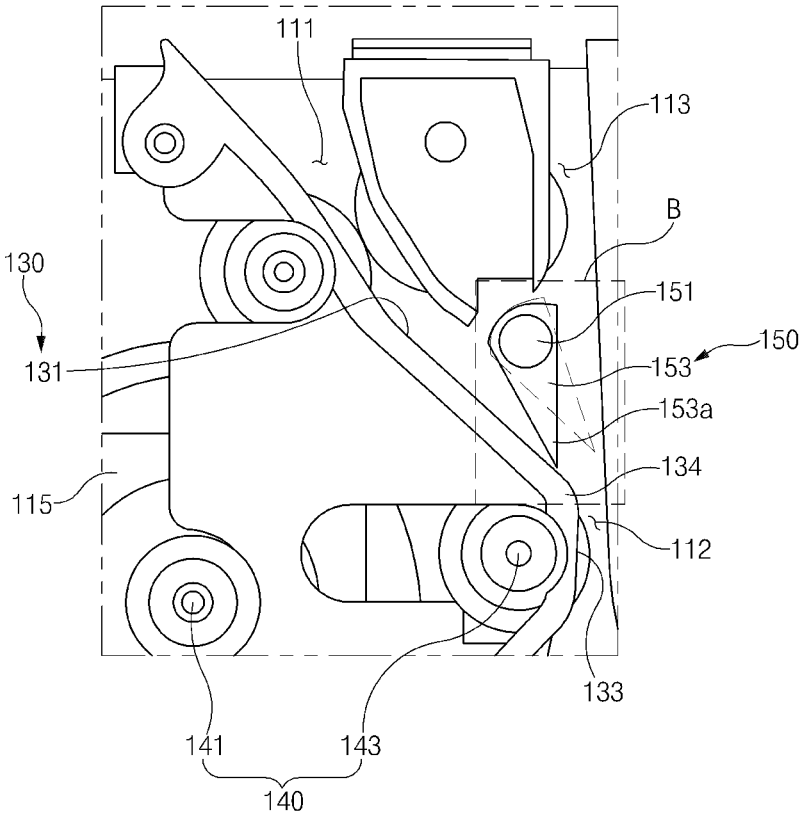
FIG. 4 is an enlarged cross-sectional view of a portion "A" of FIG. 3.

The diverter 153 may rotate between a first position (please refer to a solid line position of the diverter 153 of FIG. 4) linking the second transfer path 112 and the third transfer path 113 and a second position (please refer to a dotted line position of the diverter 153 of FIG. 4) linking the first transfer path 111 and the second transfer path 112, and here, the diverter 153 may rotate from the first position to the second position by a force applied by a medium introduced to the branch part 120 along the first transfer path 111.

In detail, the plurality of transfer paths 110 may include the first transfer path 111, the second transfer path 112, and the third transfer path 113. Also, the branch part 120 may be branched to the first transfer path 111, the second transfer path 112, and the third transfer path 113.

In the first transfer path 111, a medium may be introduced to the branch part 120, in the second transfer path 112, the medium may be introduced to or discharged from the branch part 120, and in the third transfer path 113, the medium may be introduced to or discharged from the branch part 120.

The diverter 153 may be installed in the branch part 120 and guide a medium introduced to the branch part 120 along any one of the plurality of transfer paths 110 to another transfer path among the plurality of transfer paths 110.

In detail, the diverter 153 may switch the transfer path 110 through rotation, and may rotate between the first position linking the second transfer path 112 and the third transfer path 113 and the second position linking the first transfer path 111 and the second transfer path 112.

Here, the diverter 153 may rotate from the first position to the second position by a force applied by the medium introduced to the branch part 120 along the first transfer path 111. In detail, the diverter 153 may be set in the first position as an initial position and may be rotated by a force applied by the medium transferred from the first transfer path 111 to the second transfer path 112 to one surface thereof so as to be changed in position from the first position to the second position. That is, the diverter 153 applied to the present disclosure may switch a path by a force applied by the medium, without having to drive a separate solenoid or without transmission of power from a power providing part.

Accordingly, the diverter 153 may be switched from a state of linking the second transfer path 112 and the third transfer path 113 to a state of linking the first transfer path 111 and the second transfer path 112 by a pressing force of the medium.

Also, after the diverter 153 is rotated to the second position, if the pressing force of the medium is not applied thereto, the diverter 153 may be restored to the first position from the second position.

In detail, the diverter 153 may be configured such that the first position of the diverter 153 is set as an initial position so the diverter 153 is restored to the first position as the original position if a force is not applied to the diverter 153. Here, a force restoring the diverter 153 is not limited, and, for example, the diverter 153 may be restored to the first position by a self-load thereof or by a separate restoring member.

According to the path switching structure according to an exemplary embodiment of the present disclosure, a path may be switched by rotating the diverter 153 by a force applied by a medium, even without having to drive a separate solenoid or even without transmission of power from a power providing part. Thus, a path of the medium may be accurately and stably switched and components may be simplified.

The path switching structure according to an exemplary embodiment of the present disclosure may further include an elastic member 160 connected to the medium branch apparatus 150 and providing a restoring force when the diverter 153 is restored from the second position to the first position.

Here, the elastic member 160 may be a spring as illustrated. However, the elastic member 160 is not limited thereto and may be variously modified as long as it can restore the diverter 153 from the second position to the first position.

Here, a force restoring the diverter 153 from the second position to the first position is not limited to the restoring force provided by the elastic member 160 and the diverter 153 may be restored by a self-load, or the like.

Meanwhile, the medium branch apparatus 150 may further include a rotational shaft 151 in which the diverter 153 is installed and a connection bracket 155 installed in the rotational shaft 151 and connected to the elastic member 160.

Figure 6:
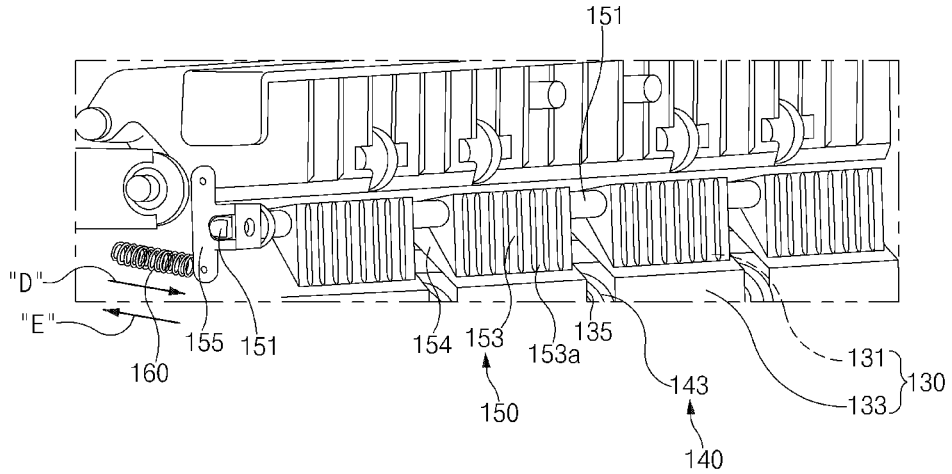
FIG. 6 is a perspective view illustrating a state in which a medium branch apparatus applied to an exemplary embodiment of the present disclosure is installed.
Figure 8:
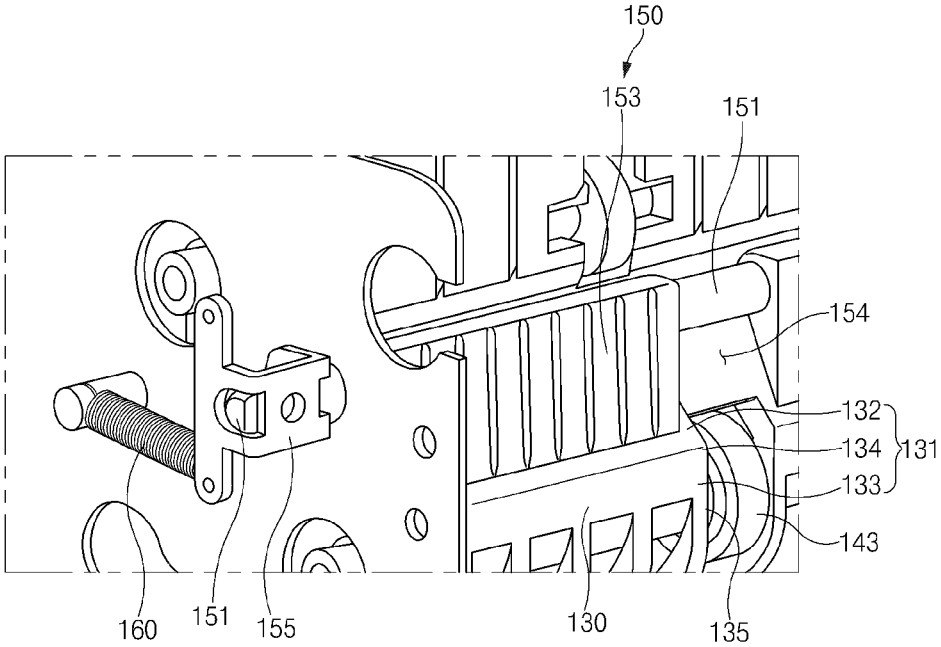
FIG. 8 is an enlarged perspective view of a portion of FIG. 6.

In detail, as illustrated in FIGS. 6 and 8, the connection bracket 155 may be fixed to and installed in an end portion of the rotational shaft 151 and connected to the elastic member 160. Accordingly, the medium branch apparatus 150 applied to the present disclosure may be stably restored from the second position to the first position upon receiving a restoring force from the elastic member 160 by means of the connection bracket 155.

Figure 3:
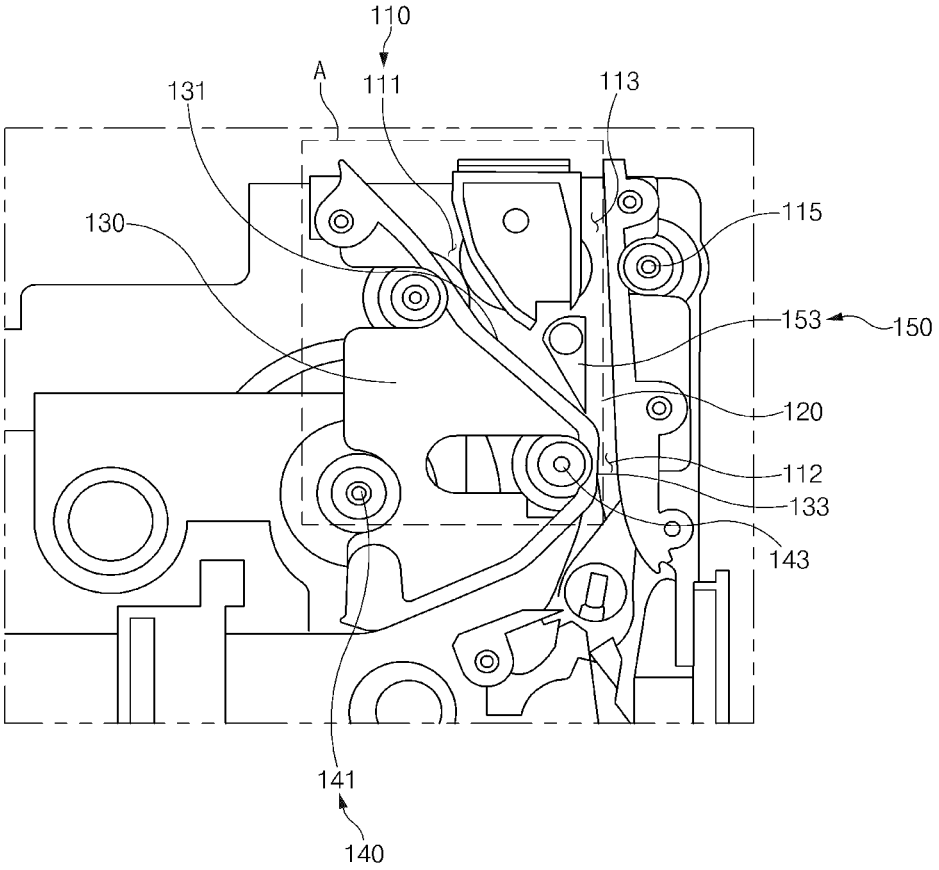
FIG. 3 is a perspective view illustrating a path switching structure according to an exemplary embodiment of the present disclosure.
Figure 5:
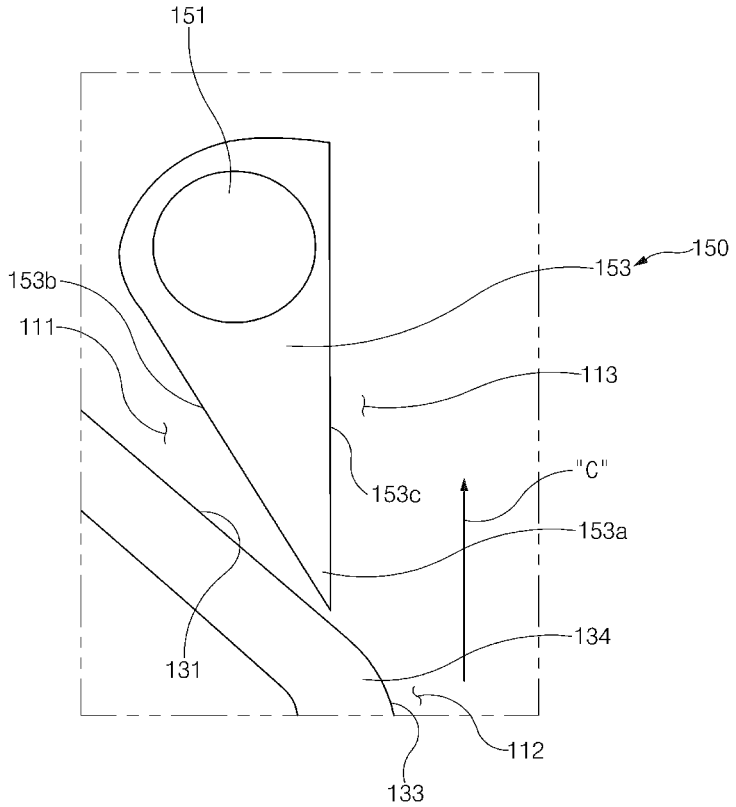
FIG. 5 is an enlarged cross-sectional view of a portion "B" of FIG. 4.

Meanwhile, referring to an exemplary embodiment illustrated in FIGS. 3 to 5, a guide member 130 having a first guide surface 131 guiding a medium transferred along the first transfer path 111 may be further provided. Also, the diverter 153 may be rotated from the first position to the second position when a force is applied thereto by the medium, and when a force is not applied to the diverter 153, the diverter 153 may be mounted on the first guide surface 131 and maintained in the first position.

In detail, in the first position of the diverter 153, an end portion 153*a* of the diverter 153 may be mounted on the first guide surface 131, and the first position of the diverter 153 may be an initial position of the diverter 153. Thus, when a force is not applied to the diverter 153, the diverter 153 may be maintained in the first position. Also, even after the diverter 153 is rotated to the second position by a force applied from the medium, when entry of the medium moving along the first transfer path is completed, the diverter 153 may be restored to the first position and mounted on the first guide surface 131. That is, the first guide surface 131 may serve as a stopper setting the initial position of the diverter 153.

Accordingly, the path switching structure according to the present disclosure does not need a separate stopper for setting the initial position or restoration position of the diverter 153, and since the diverter 153 is mounted on the guide member 130 in the initial position, deformation of the initial position due to deformation of a separately provided stopper may be prevented.

The guide member 130 may further include a second guide surface 133 guiding the medium transferred along the second transfer path 112.

Also, referring to FIGS. 4 and 5, the guide member 130 may further include a bent portion 134 formed to be bent between the first guide surface 131 and the second guide surface 133. When the diverter 153 is mounted on the first guide surface 131 spaced apart from the bent portion 134 as the end portion 153*a* thereof is mounted on the first guide surface 131, the second guide surface 133 may protrude toward the second transfer path 112, relative to the diverter 153.

That is, when the end portion 153*a* of the diverter 153 is mounted on the first guide surface 131, the portion of the diverter 153 mounted on the first guide surface 131 may be positioned in a portion on the side of the first transfer path 111 behind the bent portion 134 by a predetermined distance from the bent portion 134. Accordingly, when the diverter 153 is placed in the first position, the bent portion 134 may protrude toward the second transfer path 112, relative to the end portion 153*a* of the diverter 153.

Accordingly, when the medium moves from the second transfer path 112 to the third transfer path 113 (in a direction indicated by "C" of FIG. 5), the transferred medium may be prevented from being caught by the end portion 153*a* of the diverter 153, making flow of the medium smooth.

Meanwhile Referring to an exemplary embodiment illustrated in FIGS. 5 to 8, the diverter 153 may include a first surface 153*b* disposed on the first transfer path 111 and coming into contact with the medium transferred along the first transfer path 111 and a second surface 153*c* disposed on the third transfer path 113. The first surface 153*b* may have a planar shape and come into line-contact or surface-contact with the medium transferred along the first transfer path 111 in a direction perpendicular to the direction in which the medium is transferred.

That is, referring to FIG. 5, the diverter 153 may include the first surface 153*b* on the first transfer path 111 and the second surface 153*c* on the third transfer path 113. The end portion 153*a* of the diverter 153 may be provided at a lower portion where the first surface 153*b* and the second surface 153*c* meet. Also, referring to FIG. 7, the first surface 153*b* and the second surface 153*c* have a flat surface, and thus, the first surface 153*b* may come into line-contact or surface-contact with the medium transferred along the first transfer path 111 in a direction perpendicular to the direction in which the medium is transferred. In detail, as described hereinafter, the first surface 153*b* may come into line-contact or surface-contact with the medium by a preset length in a direction perpendicular to the direction in which the medium is transferred.

Accordingly, compared with the related art in which the blades of the diverter 153 have an eggplant shape, and thus, when the medium collides with the blades, a contact portion is concentrated to damage the medium, the diverter 153 applied to the present disclosure comes into line-contact or surface-contact with the medium in a direction perpendicular to the transfer direction of the medium, a portion where the diverter 153 and the medium are in contact is not concentrated.

Thus, when the diverter 153 according to the present disclosure is applied, portions where the diverter 153 and the transferred medium are in contact are distributed to minimize damage to the medium to enhance transfer quality of the medium.

Also, when the diverter 153 is placed in the first position, the bent portion 134 may protrude toward the second transfer path 112, relative to the second surface 153*c*.

That is, when the diverter 153 is placed in the first position as in the exemplary embodiment of FIG. 5, the second surface 153*c* may be disposed to farther from the second transfer path 112 and the third transfer path 113, than the bent portion 134. Accordingly, when the medium is transferred to from the second transfer path 112 to the third transfer path 113 (please refer to the direction indicated by "C" of FIG. 5) the second surface 153*c* may be prevented from interfering with flow of the transferred medium.

Here, the diverter 153 may have a shape in which a cross-section of the rotational shaft 151 in an axial direction is narrowed toward an end portion thereof. Thus, when the diverter 153 is switched from the first position to the second position, the diverter 153 may be smoothly switched by a force applied by the medium and collision of the end portion of the diverter 153 with the medium in the first position may be minimized.

Figure 7:
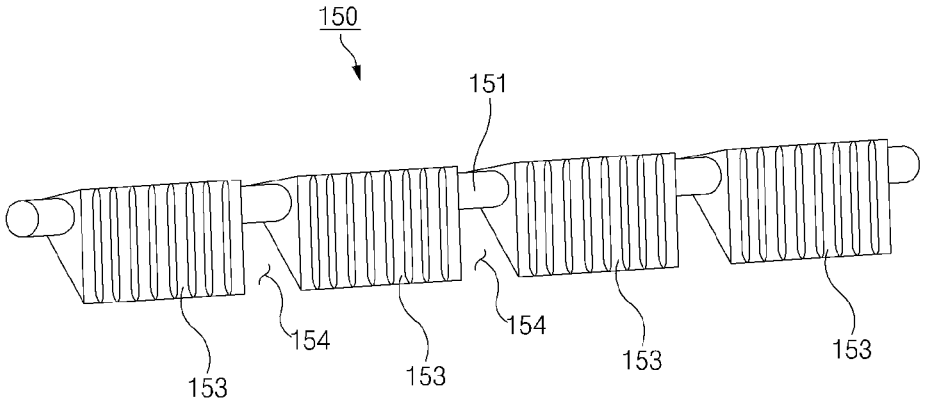
FIG. 7 is a perspective view illustrating a medium branch apparatus applied to an exemplary embodiment of the present disclosure.

The diverter 153 may be integrally formed as a single member and inserted into the rotational shaft 151, or may be manufactured as a plurality of detachable members which can be inserted into the rotational shaft 151 at a preset interval (please refer to FIG. 7).

Although not shown in detail, the diverter 153 may be formed to extend in the axial direction of the rotational shaft 151 and may include a plurality of roller position recesses 154 formed to be depressed in a direction perpendicular to the rotational shaft 151. Here, the roller position recesses 154 may be provided to correspond to positions to which portions of second separating rollers 143 (to be described hereinafter) are inserted.

Also, as in another exemplary embodiment of the diverter 153 illustrated in FIG. 7, a plurality of diverters 153 may be installed to be spaced apart from each other in an axial direction of the rotational shaft 151, and roller position recesses 154 may be provided between the plurality of diverters 153. That is, the plurality of diverters 153 may be disposed to be spaced apart from each other by an installation position of the second separating rollers 153 as described hereinafter. However, rollers insertedly installed in the roller position recesses 154 are not limited to the second separating rollers 143 and, for example, transfer rollers transferring a medium, and the like, may also be inserted and installed therein.

The first guide surface 131 may have a flat shape, come into line-contact or surface-contact with the first surface 153*b* of the diverter 153 in a transfer direction in which the medium is transferred along the first transfer path 111, and have a roller hole 135 formed in a penetrating manner to correspond to the roller position recess 154.

That is, the first guide surface 131 may have a flat shape to correspond to the first surface 153*b* of the diverter 153. Accordingly, the first guide surface 131 and the diverter 153 may come into line-contact or surface-contact with each other in a direction perpendicular to a transfer direction of the medium, and thus, contact surfaces thereof may be increased. In detail, the first surface 153*b* of the diverter 153 may be formed to be flat by a length between the plurality of roller position recesses 154 into which rollers are inserted; and the first guide surface 131 may have a flat shape to correspond to the first surface 153*b*. Accordingly, the first surface 131 of the diverter 153 may come into line-contact (or surface-contact) with the medium by an interval between the rollers in a direction perpendicular to the transferred medium. Accordingly, the diverter 153 may be stably mounted on the first guide surface 131 in the first position.

Referring to the exemplary embodiment illustrated in FIGS. 3 and 4, a separating member 140 transferring the medium which moves along the first transfer path 111 and the second transfer path 112 may be further provided. In detail, the separating member 140 may include a first separating roller 141 and a second separating roller 143. The second separating roller 143 may be installed to be engaged with the first separating roller 143 and rotated according to driving of the first separating roller 141. Also, the second separating roller 143 may be inserted and installed in the roller hole 135 and transfer the medium introduced to the first transfer path 111 and the second transfer path 112.

That is, since the first guide surface 131 of the guide member 130 according to the present disclosure may include a flat surface to correspond to the first surface 153*b* of the diverter 153 and a contact surface between the first guide surface 131 and the diverter 153 is larger than that of the related art, a size of a roller penetrating through the first guide surface 131 is preferably reduced to be small. Thus, the separating member 140 applied to the present disclosure may be divided into the first separating roller 141 and the second separating roller 143 and applied. The first separating roller 141 may be relatively large and receive power, while the second separating roller 143 may be relatively small and engaged with the first separating roller to receive a rotational force. Here, the second separating roller 143 may be inserted and installed in the roller hole 135.

Through the configuration of the separating member 140, the path switching structure according to the present disclosure may provide an effect of smoothly transferring the medium, while increasing a contact surface between the guide member 130 and the diverter 153. Also, according to the present disclosure, since an insertion recess into which end portions of a plurality of blades protruding to have an eggplant shape are inserted to overlap are not required to be provided on an outer circumferential surface of the diverter as in the related art is not required, occurrence of a jam due to assembly tolerance may be prevented in advance.

As described above, according to the path switching structure and the medium storage apparatus and the banking device having the same according to an exemplary embodiment of the present disclosure, since a path is switched by rotating the diverter with a force applied by a medium, even without driving a separate solenoid or even without transmission of power from a power providing part, a path of the medium may be accurately and stably switched and components may be simplified.

According to the present disclosure, a path may be switched without driving a separate solenoid or without providing power. Thus, a path of a medium may be accurately and stably switched.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A path switching structure comprising:

a branch part from which a plurality of transfer paths along which a medium is transferred is branched;

a medium branch apparatus having a diverter guiding the medium introduced to the branch part along any one of the plurality of transfer paths to another transfer path among the plurality of transfer paths; and a guide member having a first guide surface guiding the medium transferred along a first transfer path, a second guide surface guiding the medium transferred along a second transfer path and a bent portion formed to be bent between the first guide surface and the second guide surface, wherein the plurality of transfer paths include the first transfer path along which the medium is introduced to the branch part, the second transfer path in which the medium is introduced to the branch part or the medium is discharged from the branch part, and a third transfer path in which the medium is introduced to the branch part or the medium is discharged from the branch part, the diverter includes a first surface disposed on the first transfer path and coming into contact with the medium transferred along the first transfer path and a second surface disposed on the third transfer path, the diverter is rotated between a first position linking the second transfer path and the third transfer path and a second position linking the first transfer path and the second transfer path and is rotated from the first position to the second position by a force applied by the medium introduced to the branch part along the first transfer path, in a state in which the diverter is mounted on the first guide surface spaced apart from the bent portion as an end portion of the diverter is mounted on the first guide surface, the second guide surface protrudes toward the second transfer path, relative to the diverter, and wherein when the diverter is placed in the first position, the bent portion protrudes toward the second transfer path, relative to the second surface for preventing the medium transferred from the second transfer path to the third transfer path from being caught by the diverter.

2. The path switching structure according to claim 1, wherein, after the diverter is rotated to the second position, when a force by the medium is not applied any longer, the diverter is restored from the second position to the first position.

3. The path switching structure according to claim 2, further comprising:

an elastic member connected to the medium branch apparatus and providing a restoring force when the diverter is restored from the second position to the first position.

4. The path switching structure according to claim 1, wherein, when a force by the introduced medium is applied, the diverter is rotated from the first position to the second position, and when the force is not applied, the diverter is mounted on the first guide surface and maintained in the first position.

5. The path switching structure according to claim 4, wherein the first surface has a planar shape and comes into line-contact or surface-contact with the medium transferred along the first transfer path in a direction perpendicular to a direction in which the medium is transferred.

6. The path switching structure according to claim 5, wherein the medium branch apparatus further includes a rotational shaft on which the diverter is mounted, and the diverter has a cross-section cut by the plane perpendicular to an axial direction of the rotational shaft is narrowed toward an end portion of the diverter.

7. The path switching structure according to claim 6, wherein the diverter extends in the axial direction of the rotational shaft and includes a plurality of roller position recesses provided to be depressed in the direction perpendicular to the rotational shaft and disposed in the axial direction of the rotational shaft.

8. The path switching structure according to claim 7, wherein the first guide surface has a flat shape, comes into line-contact or surface-contact with the first surface of the diverter in a direction perpendicular to a transfer direction in which the medium is transferred along the first transfer path, and has a roller hole formed in a penetrating manner to correspond to the roller position recess.

9. The path switching structure according to claim 8, further comprising:

a separating member transferring the medium moving along the first transfer path and the second transfer path, wherein the separating member includes:

a first separating roller; and a second separating roller installed to be engaged with the first separating roller, rotated according to driving of the first separating roller, and insertedly installed in the roller hole to transfer the medium introduced to the first transfer path and the second transfer path.

10. The path switching structure according to claim 6, wherein a plurality of diverters are mounted to be spaced apart from each other in the axial direction of the rotational shaft, and a plurality of roller position recesses are provided between the plurality of diverters.

11. The path switching structure according to claim 10, wherein the first guide surface has a flat shape, comes into line-contact or surface-contact with the first surface of the diverter in a direction perpendicular to a transfer direction in which the medium is transferred along the first transfer path, and has a roller hole formed in a penetrating manner to correspond to the roller position recess.

12. The path switching structure according to claim 11, further comprising:

a separating member transferring the medium moving along the first transfer path and the second transfer path, wherein the separating member includes:

a first separating roller; and a second separating roller installed to be engaged with the first separating roller, rotated according to driving of the first separating roller, and insertedly installed in the roller hole to transfer the medium introduced to the first transfer path and the second transfer path.

13. A medium storage apparatus comprising:

a medium inlet allowing a medium to be introduced therethrough;

a medium accumulation space allowing the medium introduced through the medium inlet to be accumulated therein; and a medium outlet allowing the medium accumulated in the medium accumulation space to be discharged therethrough; and a path switching structure switching a path along which the introduced or discharged medium is transferred, wherein the path switching structure includes:

a branch part from which a plurality of transfer paths along which a medium is transferred is branched;

a medium branch apparatus having a diverter guiding the medium introduced to the branch part along any one of the plurality of transfer paths to another transfer path among the plurality of transfer paths; and a guide member having a first guide surface guiding the medium transferred along a first transfer path, a second guide surface guiding the medium transferred along a second transfer path and a bent portion formed to be bent between the first guide surface and the second guide surface, wherein the plurality of transfer paths include the first transfer path along which the medium is introduced to the branch part, the second transfer path in which the medium is introduced to the branch part or the medium is discharged from the branch part, and a third transfer path in which the medium is introduced to the branch part or the medium is discharged from the branch part, the diverter includes a first surface disposed on the first transfer path and coming into contact with the medium transferred along the first transfer path and a second surface disposed on the third transfer path, the diverter is rotated between a first position linking the second transfer path and the third transfer path and a second position linking the first transfer path and the second transfer path and is rotated from the first position to the second position by a force applied by the medium introduced to the branch part along the first transfer path, in a state in which the diverter is mounted on the first guide surface spaced apart from the bent portion as an end portion of the diverter is mounted on the first guide surface, the second guide surface protrudes toward the second transfer path, relative to the diverter, and wherein when the diverter is placed in the first position, the bent portion protrudes toward the second transfer path, relative to the second surface for preventing the medium transferred from the second transfer path to the third transfer path from being caught by the diverter.

14. A banking device comprising:

a deposit/withdrawal part allowing a medium to be deposited or withdrawn; and a medium handling apparatus handling a medium deposited to the deposit/withdrawal part, a medium which is withdrawn, or a medium returned after being deposited to the deposit/withdrawal part and including a plurality of transfer paths along which a medium is transferred, a branch part from which the plurality of transfer paths are branched, and a path switching structure switching a path of a medium transferred from the branch part, wherein the path switching structure includes:

a medium branch apparatus having a diverter guiding the medium introduced to the branch part along any one of the plurality of transfer paths to another transfer path among the plurality of transfer paths; and a guide member having a first guide surface guiding the medium transferred along a first transfer path, a second guide surface guiding the medium transferred along a second transfer path and a bent portion formed to be bent between the first guide surface and the second guide surface, wherein the plurality of transfer paths include the first transfer path along which the medium is introduced to the branch part, the second transfer path in which the medium is introduced to the branch part or the medium is discharged from the branch part, and a third transfer path in which the medium is introduced to the branch part or the medium is discharged from the branch part, the diverter includes a first surface disposed on the first transfer path and coming into contact with the medium transferred along the first transfer path and a second surface disposed on the third transfer path, the diverter is rotated between a first position linking the second transfer path and the third transfer path and a second position linking the first transfer path and the second transfer path and is rotated from the first position to the second position by a force applied by the medium introduced to the branch part along the first transfer path, in a state in which the diverter is mounted on the first guide surface spaced apart from the bent portion as an end portion of the diverter is mounted on the first guide surface, the second guide surface protrudes toward the second transfer path, relative to the diverter, and wherein when the diverter is placed in the first position, the bent portion protrudes toward the second transfer path, relative to the second surface for preventing the medium transferred from the second transfer path to the third transfer path from being caught by the diverter.

* * * * *